US009603772B2

(12) United States Patent
Jeppsson

(10) Patent No.: US 9,603,772 B2
(45) Date of Patent: Mar. 28, 2017

(54) BEAM MECHANICAL COMPRESSION DEVICE

(71) Applicant: Physio-Control, Inc., Redmond, WA (US)

(72) Inventor: Anders Torbjörn Jeppsson, Lund (SE)

( * ) Notice: Subject to any disclaimer, the term of this patent is extended or adjusted under 35 U.S.C. 154(b) by 631 days.

(21) Appl. No.: 14/018,949

(22) Filed: Sep. 5, 2013

(65) Prior Publication Data

US 2014/0221882 A1 Aug. 7, 2014

Related U.S. Application Data

(60) Provisional application No. 61/761,128, filed on Feb. 5, 2013.

(51) Int. Cl.
*A61H 31/00* (2006.01)

(52) U.S. Cl.
CPC ... *A61H 31/006* (2013.01); *A61H 2201/0161* (2013.01); *A61H 2201/1215* (2013.01); *A61H 2201/1246* (2013.01); *A61H 2201/149* (2013.01); *A61H 2201/1664* (2013.01);
(Continued)

(58) Field of Classification Search
CPC .... A61H 2201/0107; A61H 2201/0153; A61H 2201/0157; A61H 2201/0161; A61H 2201/12–2201/1253; A61H 2201/1409; A61H 2201/1418; A61H 2201/1623; A61H 2201/1626; A61H 2201/1645; A61H 2201/1657; A61H 2201/1664; A61H 2201/1685; A61H 2201/5002; A61H 2201/5053; A61H 2201/65056; A61H 7/001–7/008; A61H 9/00; A61H 9/0007; A61H 9/0028; A61H 9/005; A61H 2205/081; A61H 2205/084; A61H 1/0292; A61H 31/00; A61H 31/004–31/008;
(Continued)

(56) References Cited

U.S. PATENT DOCUMENTS 5,913,837 A * 6/1999 Smith ..... A61H 31/008 601/134
6,386,884 B1 5/2002 Sloey
6,648,841 B1 11/2003 Sessler
(Continued)

FOREIGN PATENT DOCUMENTS

CA 2333510 A1 * 12/1999 ..... A61H 31/006
CA 2682789 A1 * 12/2010 ..... H02G 3/00
(Continued)

*Primary Examiner* — Justine Yu
*Assistant Examiner* — Michael Tsai
(74) *Attorney, Agent, or Firm* — Baker & Hostetler LLP

(57) ABSTRACT

A mechanical CPR device includes a back plate, a first tower removably attached to the back plate, a second tower removably attached to the back plate, and a beam releasably connected to each of the first tower and the second tower. The first tower can include a first linear motion device. The second tower can include a second linear motion device. Each of the first and second linear motion devices can be configured to move one end of the beam toward and away from the back plate. The first and second linear motion devices can be configured to operate in concert such that, when the back plate is resting on a surface, the beam remains substantially parallel to the surface during movement of the beam toward and away from the back plate.

17 Claims, 8 Drawing Sheets

(52) U.S. Cl.
CPC ..... *A61H 2201/5002* (2013.01); *A61H 2201/5046* (2013.01); *A61H 2201/5097* (2013.01)

(58) Field of Classification Search
CPC ..... A61H 2031/003; A61H 2203/0456; A61H 2201/1669
USPC .... 601/5, 23, 26, 33, 41, 42, 43, 44, 84, 97, 601/100, 101, 102
See application file for complete search history.

(56) References Cited

U.S. PATENT DOCUMENTS

| | | | | |
|---|---|---|---|---|
| 8,002,720 | B2 * | 8/2011 | Hansen | A61H 31/00 601/107 |
| 8,162,686 | B2 * | 4/2012 | Van Beveren | H02G 3/00 439/345 |
| 2003/0181834 | A1 | 9/2003 | Sebelius et al. | |
| 2004/0060107 | A1 | 4/2004 | Eisenberg | |
| 2006/0116614 | A1 * | 6/2006 | Jones | A61H 15/0085 601/80 |
| 2009/0137366 | A1 * | 5/2009 | Hirata | A61B 5/02438 482/9 |
| 2009/0260637 | A1 | 10/2009 | Sebelius et al. | |
| 2010/0185127 | A1 | 7/2010 | Nilsson et al. | |
| 2012/0238922 | A1 | 9/2012 | Stemple et al. | |
| 2012/0295451 | A1 * | 11/2012 | Hyun-Jun | H01R 13/6205 439/39 |

FOREIGN PATENT DOCUMENTS

| | | | | |
|---|---|---|---|---|
| GB | 1040753 | A * | 9/1966 | A61H 31/006 |
| GM | DE 2835723 | * | 2/1980 | |
| GM | DE 3339113 | * | 5/1985 | |
| IL | WO 02055784 | A2 * | 7/2002 | A47K 7/046 |
| SE | WO 2008/097153 | * | 8/2008 | |
| WO | WO 2008/066455 | A1 | 6/2008 | |
| WO | WO 2010/049861 | A1 | 5/2010 | |
| WO | WO 2010/119401 | A1 | 10/2010 | |

* cited by examiner

BEAM MECHANICAL COMPRESSION DEVICE

CROSS REFERENCE TO RELATED APPLICATIONS

The present application claims to the benefit of U.S. Provisional Patent Application 61/761,128, filed Feb. 5, 2013, the contents of which are hereby incorporated by reference in their entirety. The present application is also related to U.S. patent application Ser. No. 14/019,016 filed Sep. 5, 2013, the contents of which are hereby incorporated by reference in their entirety.

Cardiopulmonary resuscitation (CPR) is a medical procedure performed on patients to maintain some level of circulatory and respiratory functions when patients otherwise have limited or no circulatory and respiratory functions. CPR is generally not a procedure that restarts circulatory and respiratory functions, but can be effective to preserve enough circulatory and respiratory functions for a patient to survive until the patient's own circulatory and respiratory functions are restored. CPR typically includes frequent chest compressions that usually are performed by pushing on or around the patient's sternum while the patient is laying on the patient's back. For example, chest compressions can be performed at a rate of about 100 compressions per minute and at a depth of about 5 cm per compression for an adult patient. The frequency and depth of compressions can vary based on the age and size of a particular patient.

Manual CPR has several disadvantages. A person performing CPR, such as a medical first-responder, must exert considerable physical effort to maintain proper compression timing and depth. Over time, fatigue can set in and compressions can become less regular and less effective. The person performing CPR must also divert mental attention to performing manual CPR properly and may not be able to focus on other tasks that could help the patient. For example, a person performing CPR at a rate of 100 compressions per minute would likely not be able to simultaneously prepare a defibrillator for use to attempt to restart the patient's heart. Mechanical compression devices can be used with CPR to perform compressions that would otherwise be done manually. Mechanical compression devices can provide advantages such as providing constant, proper compressions for sustained lengths of time without fatiguing, freeing medical personal to perform other tasks besides CPR compressions, and being usable in smaller spaces than would be required by a person performing CPR compressions.

SUMMARY

Illustrative embodiments of the present application include, without limitation, methods, structures, and systems. In one embodiment, a mechanical CPR device includes a back plate, a first tower removably attached to the back plate, a second tower removably attached to the back plate, and a beam releasably connected to each of the first tower and the second tower. The first tower can include a first linear motion device. The second tower can include a second linear motion device. Each of the first and second linear motion devices can be configured to move one end of the beam toward and away from the back plate. The first and second linear motion devices can be configured to operate in concert such that, when the back plate is resting on a surface, the beam remains substantially parallel to the surface during movement of the beam toward and away from the back plate.

In some examples, the first linear motion device can include a first shuttle and the second linear motion device can include a second shuttle. The first shuttle can be configured to releaseably connect with a first end of the beam and the second shuttle can be configured to releaseably connect with a second end of the beam. The first shuttle can include one or more engagement points configured to engage the first end of the beam and the second shuttle can include one or more engagement points configured to engage the second end of the beam. The first end of the beam can include a first rotatable end and the second end of the beam can include a second rotatable end. The beam can include a first locking mechanism and a second locking mechanism, where the first locking mechanism is configured to lock the first rotatable end in a first position and to permit the first rotatable end to rotate in a second position, and where the second locking mechanism is configured to lock the second rotatable end in a first position and to permit the second rotatable end to rotate in a second position. The first linear motion device can include a first motor and a first threaded shaft connected to the first shuttle, and the second linear motion device can include a second motor and a second threaded shaft connected to the second shuttle. The first tower further can include a first control unit configured to control movement of the first shuttle by controlling the first motor, and the second tower can include a second control unit configured to control movement of the second shuttle by controlling the second motor.

In other examples, the first tower can include a first control unit and the second tower can include a second control unit. The first control unit and the second control unit can be configured to communicate wirelessly. The first control unit and the second control unit can also be configured to communicate via a wired connection. The wired connection can include a first electrical connection in the first tower, a second electrical connection in the back plate, and a third electrical connection in the second tower. The first and second control units can be configured to verify that the back plate is properly aligned with the first and second towers based on an ability to communicate via the first, second, and third electrical connections. The wired connection can also include a fourth electrical connection in the first tower, a fifth electrical connection in the beam, and a sixth electrical connection in the second tower. The first and second control units can be configured to verify that the beam is properly aligned with the first and second towers based on an ability to communicate via the fourth, fifth, and sixth electrical connections. At least one of the first and second control units is configured to receive one or more user inputs. The first control unit can be configured to control the first linear motion device based on the received one or more user inputs, and the second control unit can be configured to control the second linear motion device based on the received one or more user inputs.

In another embodiment, a method can include placing a patient on a back plate; removably attaching a first tower to the back plate; removably attaching a second tower to the back plate; engaging a first rotatable end of a beam to a first linear motion device of the first tower; engaging a second rotatable end of the beam to a second linear motion device of the second tower; and locking the first and second rotatable ends of the beam such that the beam is located over the patient. The first and second linear motion devices can be configured to move the beam to compress a chest of the patient between the beam and the back plate.

In some examples, placing the patient on the back plate can include placing the back plate on a surface. The method can also include causing the first and second linear motion devices move the beam toward and away from the back plate to compress the chest of the patient, where the first and second linear motion devices are configured to maintain the beam in a position substantially parallel to the surface during motion of the beam. The beam can include a compression point configured to engage the chest of the patient during motion of the beam.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure.

DETAILED DESCRIPTION OF ILLUSTRATIVE EMBODIMENTS

Mechanical CPR compression devices can provide many advantages over manual CPR compressions. Mechanical CPR compression devices can include a back plate that is placed behind the back of the patient and a compression device located above the patient's sternum area. The compression device can be connected to the back plate on both sides of the patient. When the compression device pushes against the area around the patient's sternum, the back plate provides resistance that allows the compression device to compress the patient's chest.

Traditional mechanical compression devices can have a portion with significant weight located above a user's sternum. For example, a mechanical CPR device can have a back plate behind the patient's back, a compression device above the patient's sternum, and legs along both sides of the user's chest. The compression device above the patient's sternum can include components such as a piston to perform the compressions, a motor to drive the piston, a battery to provide power to the motor, a control system to control the motor and piston, and the like. All of the components in the compression device can have significant weight. When a patient is laying back-down on a surface, the compression device of the mechanical CPR device will be above the patient making the device somewhat top heavy. While this top-heavy configuration may be an inconvenience, the mechanical CPR device can effectively operate in this manner. However, if the patient is in any other position, the weight of the compression device of the mechanical CPR device may be burdensome. For example, a patient may need to be moved to an inclined or upright position, such as to be placed onto a stretcher, to enter an elevator, to be placed in an ambulance, and the like. In these circumstances, if the mechanical CPR device is around the patient when the patient is moved to an inclined or upright position, the weight of the compression device may cause the patient to fall forward and may cause the mechanical CPR device to be moved out of proper position.

Figure 1A:
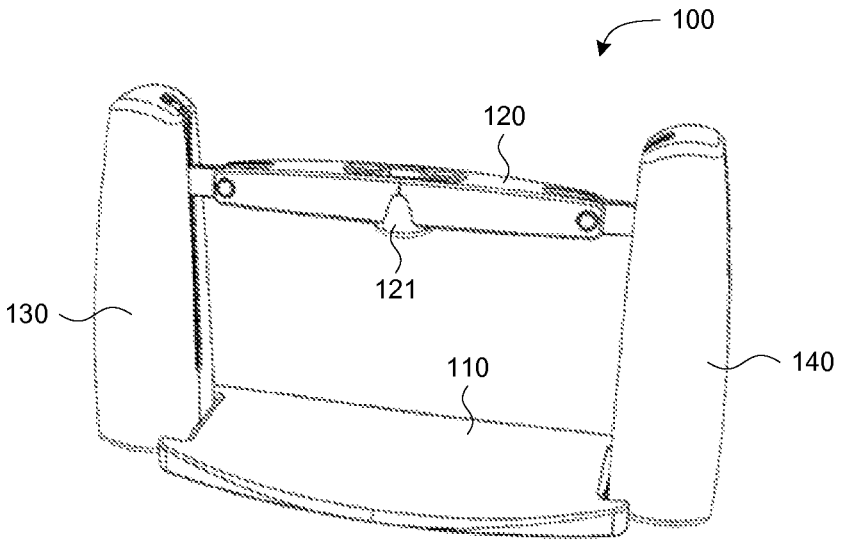
FIGS. 1A and 1B depict an embodiment of a mechanical CPR device that has two towers.
Figure 1B:
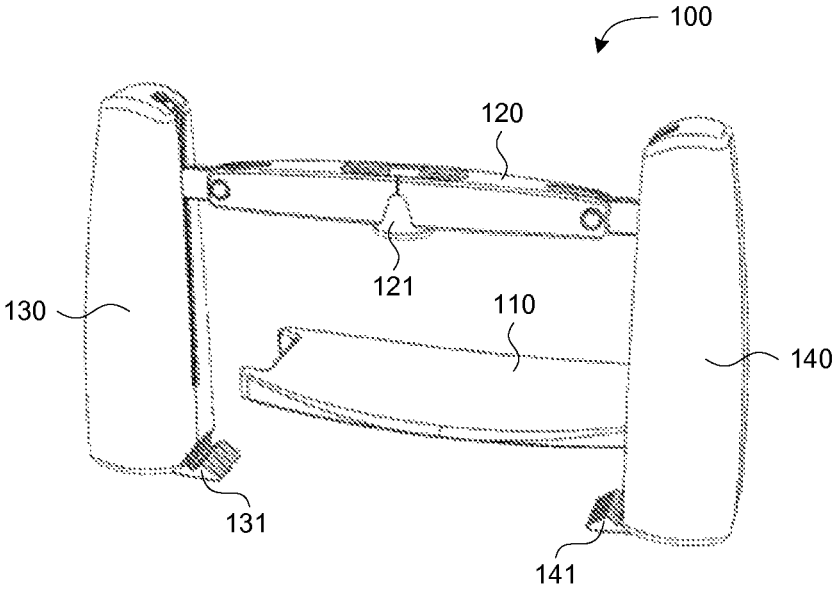

FIGS. 1A and 1B depict an embodiment of a mechanical CPR device 100 that has two towers. The mechanical CPR device 100 includes a back plate 110 that can be placed below a patient's back and a beam 120 that can be located over a patient's chest. The mechanical CPR device 100 also includes a first tower 130 and a second tower 140. The back plate 110 can be configured to removably attach to each the first and second towers 130 and 140. When items are removably attached, one item can be removed from another item. Before one item is removed, the items are attached to each other in some way, such as one item limiting movement of the other item with respect to each other in some direction. In the depiction shown in FIG. 1B, the first tower 130 can include a foot 131 and the second tower 140 can include a foot 141. The edges of the back plate 110 can be configured to physically interface with the foot 131 and the foot 141. As described in greater detail below, such a physical interface between the edges of the back plate 110 and the feet 131 and 141 can ensure proper placement of the first and second towers 130 and 140 with respect to each other. The beam 120 can be configured to releasably connect to each of the first tower 130 and the second tower 140. Items that are releasably connected are easily disconnected by a user, such as connections that can snap in and snap out, connection that do not require the use of tools to disconnect, quick-release connections (e.g., push button release, quarter-turn fastener release, lever release, etc.), and the like. Items are not releaseably connected if they are connected by more permanent fasteners, such as rivets, screws, bolts, and the like. The beam 120 can include a compression point 121 configured to engage a patient's chest on or near the patient's sternum. The first and second towers 130 and 140 can each be configured to move one end of the beam 120 toward and away from the back plate 110. When working in concert, the first and second towers 130 and 140 can maintain the beam in a substantially horizontal configuration while moving the beam vertically up and down. Such vertical motions can result in appropriate compression of a patient's chest for purposes of CPR. Such vertical motions can also provide decompression (or expansion) of a chest, rather than relying on the resiliency of the chest, if the beam 120 includes an attachment, such as a suction attachment, that can decompress (or expand) the chest.

Figure 2:
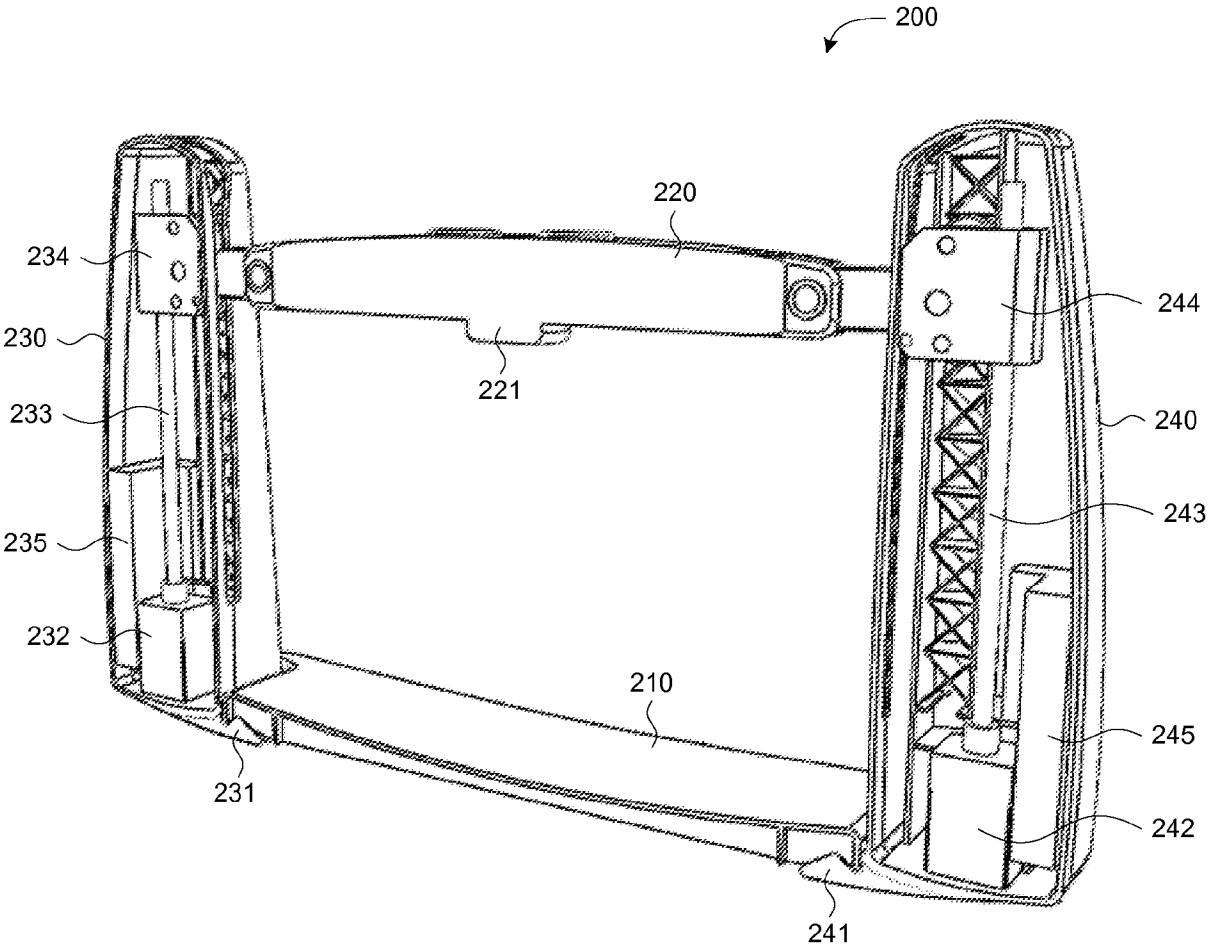
FIG. 2 depicts a cross-sectional view of an embodiment of a mechanical CPR device that has two towers.

FIG. 2 depicts a cross-sectional view of an embodiment of a mechanical CPR device 200 that has two towers. The mechanical CPR device 200 includes a back plate 210 that can be placed below a patient's back and a beam 220 that can be located over a patient's chest. The beam 220 can include a compression point 221 configured to engage a patient's chest on or near the patient's sternum. The mechanical CPR device 200 also includes a first tower 230 and a second tower 240. The back plate 210 can be configured to removably attach to each the first and second towers 230 and 240. The first tower 230 can include a foot 231 and the second tower 240 can include a foot 241. The edges of the back plate 210 can be configured to physically interface with the foot 231 and the foot 241.

The first tower 230 can also include a motor 232 and a threaded shaft 233. The threaded shaft 233 can engage a shuttle 234. The shuttle 234 can be releasably connected to one end of the beam 220. When the motor 232 turns the threaded shaft 233, the shuttle 234 moves linearly up or down; the end of the beam 220 attached to the shuttle 234 moves with the movement of the shuttle. While a threaded shaft and shuttle configuration have been depicted in FIG. 2, it is possible for alternative linear motion devices may be employed to move the end of the beam 220, such as a pneumatic actuator and other similar linear motion devices. The motor 232 can be powered by batteries, such as rechargeable batteries located in the first tower 230, by an external power source, such as an electrical outlet. The first tower 230 can also include a control unit 235 configured to control operation of the motor 232, and thus movement of the shuttle 234. The control unit 235 can also accept user inputs related to operation of the mechanical CPR device 200. For example, a user can input a desired compression depth of the beam 220 (i.e., how far the beam 220 moves toward back plate 210 during a compression), a desired frequency of compressions, a desired speed of the beam 220 during compressions, a start compression and stop compression command, and the like. The first tower 230 can include a user input device (not shown) that allows the user to input selections. Such a user input device can include one or more buttons, a display, a touchscreen and/or any other component on the exterior of the first tower 230. The first tower 230 can also accept user inputs wirelessly from an external computing device. For example, a user may input selections into a mobile computing device, such as a cell phone, that are communicated wirelessly, such as via a Bluetooth connection or Wi-Fi connection, to the first tower 230.

Similar to the first tower 230, the second tower 240 can include a motor 242 and a threaded shaft 243. The threaded shaft 243 can engage a shuttle 244. The shuttle 244 can be releasably connected to another end of the beam 220. When the motor 242 turns the threaded shaft 243, the shuttle 244 moves linearly up or down; the end of the beam 220 attached to the shuttle 244 moves with the movement of the shuttle. While a threaded shaft and shuttle configuration have been depicted in FIG. 2, it is possible for alternative forms of moving the end of the beam 220 linearly may be employed. The second tower 240 can also include a control unit 245 configured to control operation of the motor 242, and thus movement of the shuttle 244. The control unit 245 can also receive user inputs similar to the ways in which control unit 235 receives user inputs.

Control units 235 and 245 can communicate to coordinate movements of shuttles 234 and 244 such that beam 220 remains substantially horizontal during compressions (i.e., substantially parallel to a surface upon which the back plate 210 rests). Control units 235 and 245 can communicate via a wired connection. As discussed in greater detail below with respect to FIG. 6, such a wired connection between control units 235 and 245 can be established through the back plate 210, through beam 220, or in parallel through back plate 210 and beam 220. Control units 235 and 245 can also communicate via a wireless connection, such as a Bluetooth connection or a Wi-Fi connection. If a user input is received by one of the control units 235 and 245, the user input can be communicated from the one of the control units 235 and 245 that received the user input to the other of the control units 235 and 245.

Figure 3A:
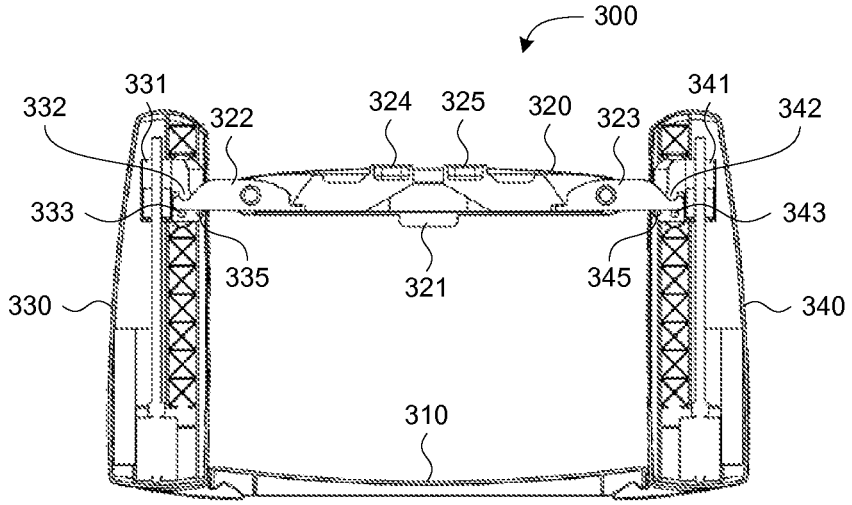
FIGS. 3A and 3B depict views of an embodiment of a mechanical CPR device.
Figure 3B:
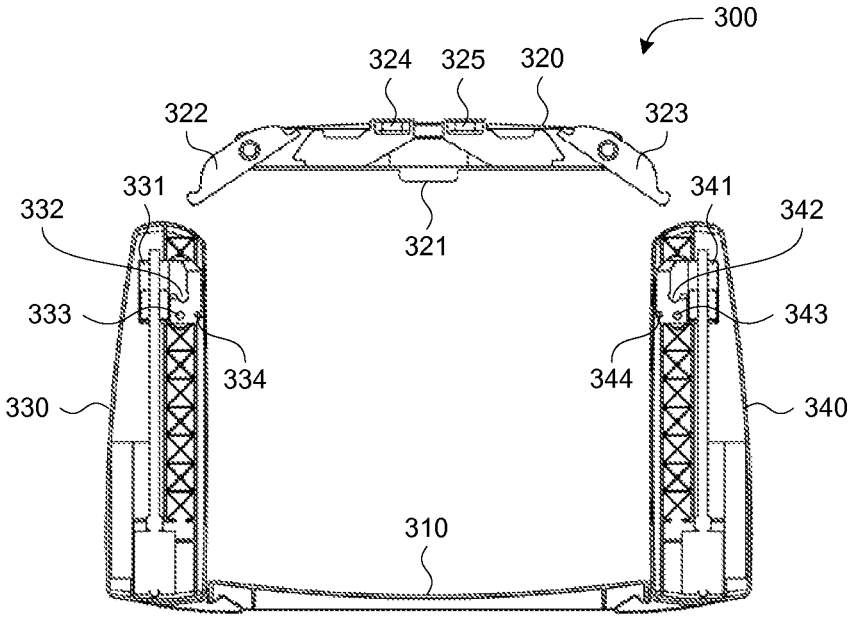

FIGS. 3A and 3B depict views of an embodiment of a mechanical CPR device 300. The mechanical CPR device 300 includes a back plate 310, a beam 320, a first tower 330, and a second tower 340. The back plate 310 can be configured to removably attach to each the first and second towers 330 and 340, such as by removably attaching to a foot of each of the first and second towers 330 and 340.

The beam 320 can include a compression point 321, rotatable ends 322 and 323, and locking mechanisms 324 and 325. Locking mechanism 324 is configured to releasably lock rotatable end 322 in place in the configuration shown in FIG. 3A. After the locking mechanism 324 is released, the rotatable end 322 is free to rotate at least to some degree. Similarly, locking mechanism 325 is configured to releasably lock rotatable end 323 in place in the configuration shown in FIG. 3A. After the locking mechanism 325 is released, the rotatable end 323 is free to rotate at least to some degree. In the embodiments depicted in FIGS. 3A and 3B, locking mechanisms 324 and 325 are in the form of sliders that can released by retracting the sliders toward the center of the beam 320.

First tower 330 can include a shuttle 331 that is configured to engage rotatable end 322 of beam 320. In the embodiment depicted in FIGS. 3A and 3B, the shuttle 331 includes engagement points 332, 333, and 334. The engagement points 332, 333, and 334 are positioned such that when the rotatable end 322 of beam 320 is engaged with engagement points 332, 333, and 334 and rotatable end 322 is locked by locking mechanism 324 (as shown in the configuration in FIG. 3A), the rotatable end 322 is held securely by shuttle 331. Second tower 340 can include a shuttle 341 that is configured to engage rotatable end 323 of beam 320. In the embodiment depicted in FIGS. 3A and 3B, the shuttle 341 includes engagement points 342, 343, and 344. The engagement points 342, 343, and 344 are positioned such that when the rotatable end 323 of beam 320 is engaged with engagement points 342, 343, and 344 and rotatable end 323 is locked by locking mechanism 325 (as shown in the configuration in FIG. 3A), the rotatable end 323 is held securely by shuttle 341.

In the configuration shown in FIG. 3A, the beam 320 is held securely in place by shuttles 331 and 341. When the shuttles 331 and 341 are moved in concert vertically, the beam 320 moves vertically with the shuttles 331 and 341 while the beam remains substantially horizontal. In this way, when a patient is placed on back plate 310 with the patient's sternum area below the compression point 321. When the beam 320 is moved down toward the back plate 310, the compression point 321 will engage the patient on or near the patient's sternum and the compression point 321 can compress the patient's chest. The beam 320 can then be moved upward away from the patient's chest to end the compression. In another embodiment, if the beam 320 included an attachment that can decompress or expand the chest, the beam can be moved upward away from the patient's chest to decompress or expand the patient's chest. At that point, the beam 320 can be moved downward to allow the chest to contract. Any vertical motion cycle can be repeated as desired to provide compressions for CPR.

When compressions of the patient's chest are no longer desired, the beam 320 can be removed from the first tower 330 and the second tower 340. From the configuration shown in FIG. 3A, the locking mechanisms 324 and 325 can be slid toward the center of the beam 320 to release rotatable ends 322 and 323. Once the rotatable ends 322 and 323 are released, the beam 320 can be lifted upward to the position shown in FIG. 3B where the beam has been removed from the first tower 330 and the second tower 340. The reverse operation is also possible. From the position shown in FIG. 3B, the beam 320 can be engaged with the first tower 330 and the second tower 340 and securely held by the first tower 330 and the second tower 340. From the position shown in FIG. 3B, with the rotatable ends 322 and 323 released from locking mechanisms 324 and 325, the beam 320 can be lowered until the rotatable end 322 engages with one of the engagement points 332, 333, and 334, and the rotatable end 323 engages with one or more engagement points 342, 343, and 344. As the beam 320 is pushed downward, one or more of the engagement points 332, 333, and 334 can cause the rotatable end 322 to rotate until it is locked by locking mechanism 324, and one or more of the engagement points 342, 343, and 344 can cause the rotatable end 323 to rotate until it is locked by locking mechanism 325. At this point, the beam 320 can be engaged with and securely held by the shuttles 331 and 341 in the configuration shown in FIG. 3A.

Figure 4A:
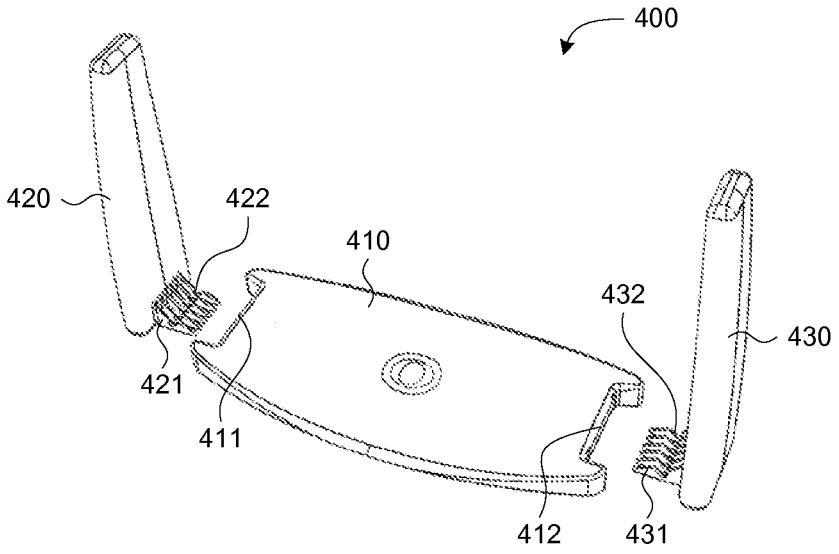
FIGS. 4A to 4C depict an embodiment of a mechanical CPR device with a back plate and two towers.
Figure 4B:
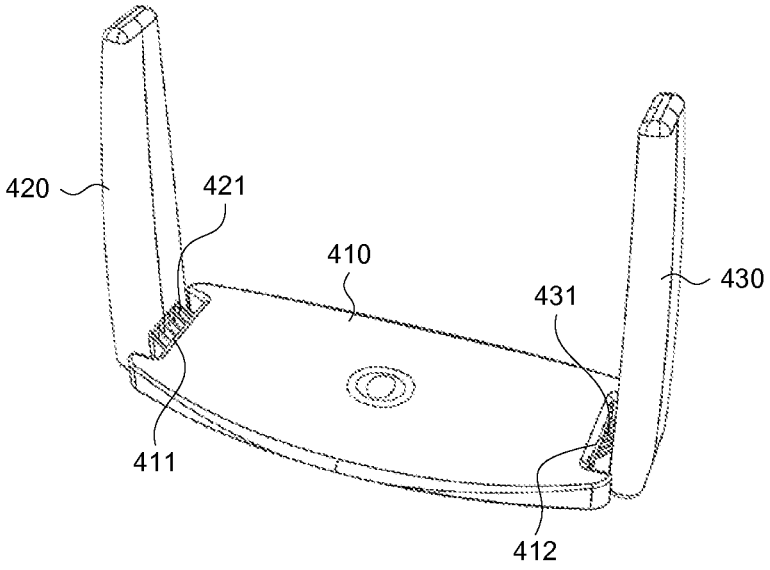
Figure 4C:
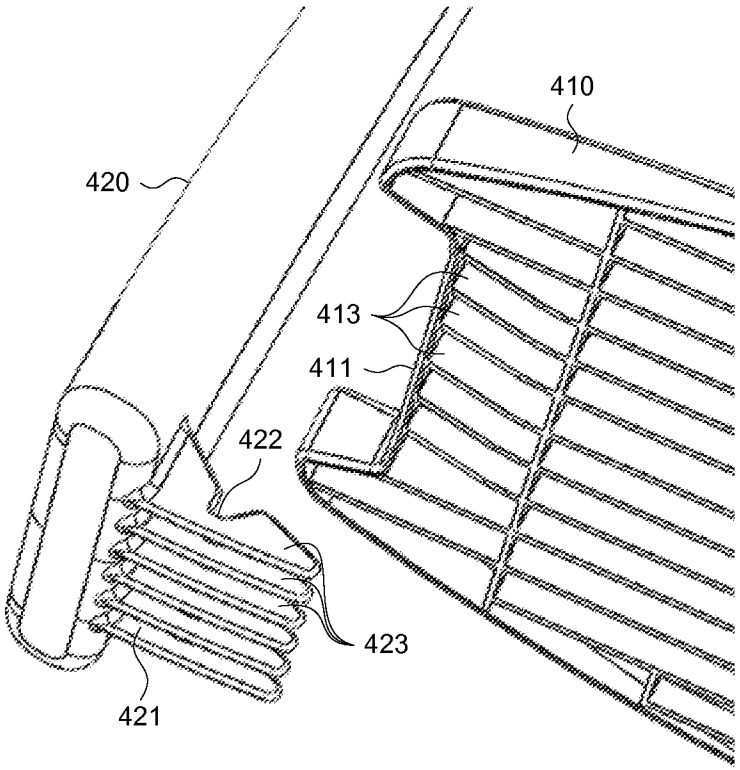

FIGS. 4A to 4C depict an embodiment of a mechanical CPR device 400 with a back plate 410 and two towers 420 and 430. The back plate 410 can include a first end 411 and a second end 412. The first tower 420 can have a foot 421. The foot 421 can be in the shape of a wedge that has a trough 422. The first end 411 of the back plate 410 can be shaped to fit within trough 422 of foot 421. Similarly, the second tower 430 can have a foot 431. The foot 431 can be in the shape of a wedge that has a trough 432. The second end 412 of the back plate 410 can be shaped to fit within trough 432 of foot 431.

The back plate 410 can be moved from the configuration shown in FIG. 4A—where the back plate 410 is separated from each of the first tower 420 and the second tower 430—to the configuration shown in FIG. 4B—where the back plate 410 is removably attached to each of the first tower 420 and the second tower 430. From the position shown in FIG. 4A, the first tower 420 can be pushed toward the back plate 410 until the first end 411 of the back plate 410 engages the foot 421 of the first tower 420. The first tower 420 can be further pushed toward the back plate 410 until the first end 411 of the back plate 410 engages the trough 422 of the foot 421 in the configuration shown in FIG. 4B. Similarly, the second tower 430 can be pushed, from the configuration shown in FIG. 4A, toward the back plate 410 until the second end 412 of the back plate 410 engages the foot 431 of the second tower 430. The second tower 430 can be further pushed toward the back plate 410 until the second end 412 of the back plate 410 engages the trough 432 of the foot 431 in the configuration shown in FIG. 4B.

FIG. 4C depicts a lower perspective view of back plate 410 and first tower 420. In the embodiment shown in FIG. 4C, the lower portion of the back plate 410 can include ribs 413. The foot 421 of first tower 420 can include a number of protrusions 423. Each of the protrusions 423 can have a wedge shape and can define a portion of the trough 422. The ribs 413 of the back plate 410 and the protrusions 423 of the foot 421 can be configured such that, when the first end 411 of back plate 410 engages the trough 422 of the foot 421, portions of protrusions 423 are located between the ribs 413. The widths of the ribs 413 and the protrusions 423 can be configured such that the ribs 413 and the protrusions 423 ensure proper alignment of the back plate 410 with respect to the first tower 420. Similarly, although not shown in FIG. 4C, the back plate 410 can include ribs near the second end 412 and the foot 431 of the second tower 430 can include a number of protrusions.

Figure 5A:
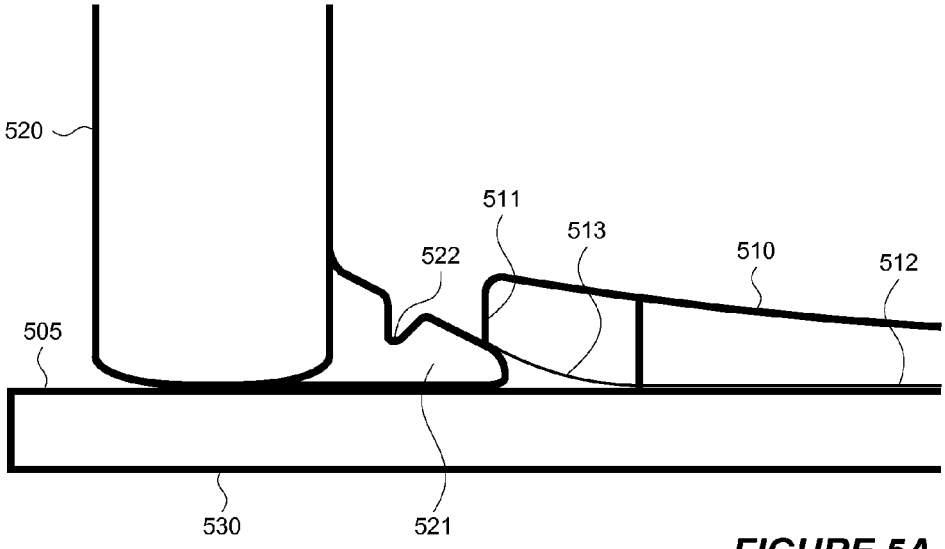
FIGS. 5A and 5B depict cross sectional views of an embodiment of a back plate 510 being removably attached to a tower 520.
Figure 5B:
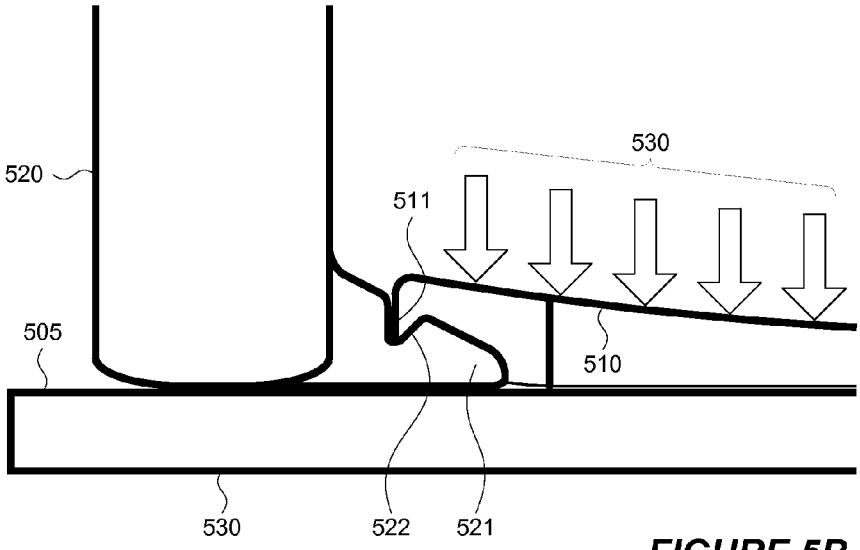

FIGS. 5A and 5B depict cross sectional views of an embodiment of a back plate 510 being removably attached to a tower 520. The back plate 510 can include a side 511, a lower surface 512, and a curved surface between the lower surface 512 and the side 511. The lower surface 512 of the back plate can be placed on a surface 505, as shown in FIGS. 5A and 5B. The tower 520 can include a foot 521 that includes a trough 522. The trough 522 can be fingered to receive the side 511. The tower 520 can also be placed on the surface 505. The curved surface 513 can be curved up from the lower surface 512 such that, when the tower 520 is pushed toward the back plate 510, the curved surface 513 comes into contact with an upper surface of the foot 521 (as shown in FIG. 5A). From that portion, the tower 520 can be further pushed toward back plate 510. As the tower 520 moves closer to the back plate 510, the side 511 of the back plate 510 may raise up along the upper surface of the foot 521 until the side 511 falls into the trough 522. Once the side 511 is in the trough 522, the back plate 510 is removably attached to the tower 520. If a distributed weight 530 is placed on the top of back plate 510, such as the distributed weight 530 of a patient laying on the back plate 510, the downward force of the distributed weight 530 can hold the side 511 in place in the trough.

Figure 6:
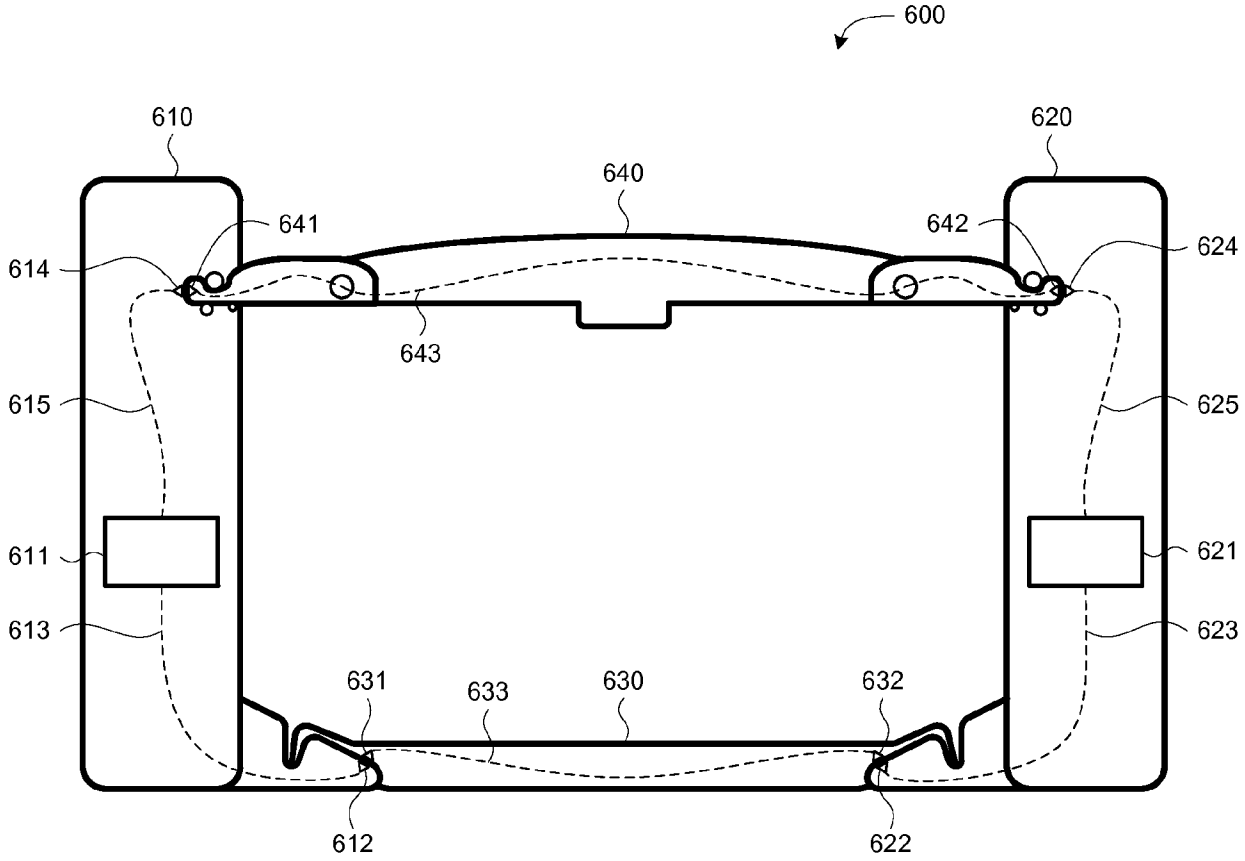
FIG. 6 depicts an embodiment of a mechanical CPR device that has one or more wired electrical connections between control units of towers.

FIG. 6 depicts an embodiment of a mechanical CPR device 600 that has one or more wired electrical connections between control units of towers. The mechanical CPR device 600 includes a first tower 610, a second tower 620, a back plate 630, and a beam 640. The first tower 610 includes a control unit 611. The first tower 610 also includes a first electrical connection point 612 connected to the control unit 611 by a first electrical connection 613 and a second electrical connection point 614 connected to the control unit 611 by a second electrical connection 615. The second tower 620 includes a control unit 621. The second tower 620 also includes a first electrical connection point 622 connected to the control unit 621 by a first electrical connection 623 and a second electrical connection point 624 connected to the control unit 621 by a second electrical connection 625. The back plate 630 includes a first electrical connection point 631 and a second electrical connection point 632 connected to each other by an electrical connection 633. The beam 640 includes a first electrical connection point 641 and a second electrical connection point 642 connected to each other by an electrical connection 643.

An electrical connection can be made between the control unit 611 of the first tower 610 and the control unit 621 of the second tower 620 via the back plate 630. The first electrical connection point 612 of the first tower 610 can be configured to make an electrical connection with the first electrical connection point 631 of the back plate 630. In one embodiment, the first electrical connection point 612 of the first tower 610 can make an electrical connection with the first electrical connection point 631 of the back plate 630 when the back plate 630 is properly aligned with respect to the first tower 610, such as when ribs on a lower side of the back plate 630 are properly aligned with protrusions of a foot of first tower 610. The second electrical connection point 632 of the back plate 630 can be configured to make an electrical connection with the first electrical connection point 622 of the second tower 620. In one embodiment, the second electrical connection point 632 of the back plate 630 can make an electrical connection with the first electrical connection point 622 of the second tower 620 when the back plate 630 is properly aligned with respect to the second tower 620, such as when ribs on a lower side of the back plate 630 are properly aligned with protrusions of a foot of second tower 620. In this way, a wired electrical connection can be made between control unit 611 of the first tower 610 and the control unit 621 of the second tower 620 via the back plate 630. The electrical connection between control unit 611 of the first tower 610 and the control unit 621 of the second tower 620 via the back plate 630 can be used for the control unit 611 and the control unit 621 to communicate with each other and/or for the control unit 611 and the control unit 621 to ensure that the back plate 630 is properly aligned with respect to each of the first tower 610 and the second tower 620.

An electrical connection can be made between the control unit 611 of the first tower 610 and the control unit 621 of the second tower 620 via the beam 640. The second electrical connection point 614 of the first tower 610 can be configured to make an electrical connection with the first electrical connection point 641 of the beam 640. In one embodiment, the second electrical connection point 614 of the first tower 610 can make an electrical connection with the first electrical connection point 641 of the beam 640 when the beam 640 is securely attached to the first tower 610, such as when a rotatable end of the beam 640 is securely held by a shuttle of the first tower 610. The second electrical connection point 642 of the beam 640 can be configured to make an electrical connection with the second electrical connection point 624 of the second tower 620. In one embodiment, the second electrical connection point 642 of the beam 640 can make an electrical connection with the second electrical connection point 624 of the second tower 620 when the beam 640 is securely attached to the second tower 620, such as when a rotatable end of the beam 640 is securely held by a shuttle of the second tower 620. In this way, a wired electrical connection can be made between control unit 611 of the first tower 610 and the control unit 621 of the second tower 620 via the beam 640. The electrical connection between control unit 611 of the first tower 610 and the control unit 621 of the second tower 620 via the beam 640 can be used for the control unit 611 and the control unit 621 to communicate with each other and/or for the control unit 611 and the control unit 621 to ensure that the beam 640 is securely attached to each of the first tower 610 and the second tower 620.

The embodiment of the mechanical CPR device 600 in FIG. 6 includes two electrical connections between the control unit 611 and the control unit 621: a first electrical connection via the back plate 630 and a second electrical connection via the beam 640. Such a configuration can allow for the control unit 611 and the control unit 621 to ensure that both the back plate 630 and the beam 640 are properly connected to the first tower 610 and to the second tower 620. However, other mechanical CPR devices may include only one electrical connection, such as either one electrical connection via a back plate or one electrical connection via a beam. In such single-electrical-connection embodiments, control units in two towers may not be able to verify that both a beam and a back plate are properly connected to the two towers. However, the single-electrical-connection embodiments will still permit control units in each of the two towers to communicate via a wired electrical connection.

Figure 7B:
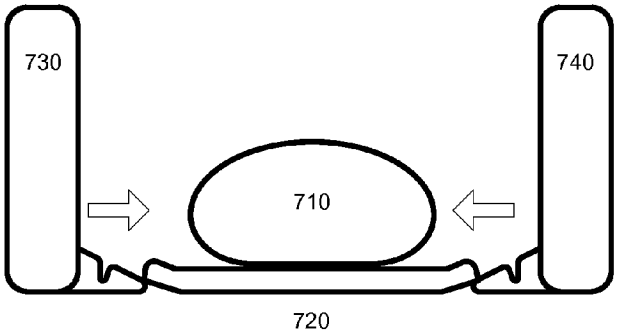
FIGS. 7A to 7D depict a method of assembling a two-tower mechanical CPR device around a patient.
Figure 7A:
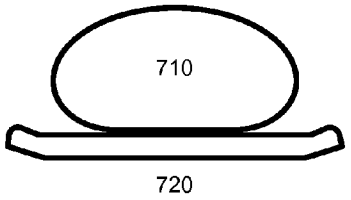
Figure 7D:
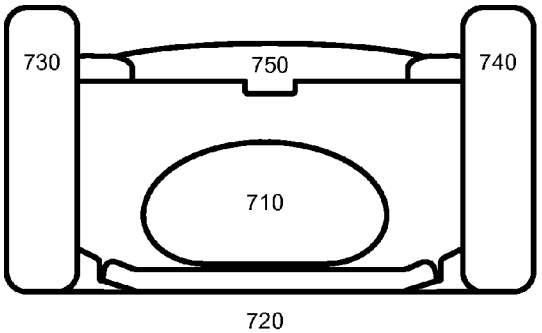
Figure 7C:
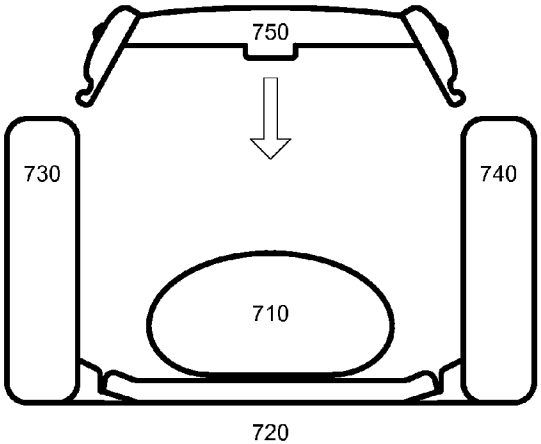

FIGS. 7A to 7D depict a method of assembling a two-tower mechanical CPR device around a patient. FIG. 7A depicts a cross section of a patient's chest 710 on top of a back plate 720. In normal operation, the patient will typically be facing up, with the patient's back toward the back plate 720. The back plate 720 can be slid underneath the patient's chest 710 or the patient can be rolled on top of the back plate 720. FIG. 7B depicts a first tower 730 and a second tower in contact with sides of the back plate. As indicated by the arrows in FIG. 7B, the first tower 730 and the second tower 740 can be pushed toward the back plate 720. The first tower 730 and the second tower 740 can be pushed toward the back plate 720 until a first side of back plate 720 is removably attached to the first tower 730 and a second side of back plate 720 is removably attached to the second tower 740. FIG. 7C depicts back plate 720 removably attached to each of the first tower 730 and the second tower 740. FIG. 7C also depicts a beam 750 with rotatable ends above the first and second towers 730 and 740. As indicated by the arrow in FIG. 7C, the beam 750 can be lowered into place between the first and second towers 730 and 740. In lowering the beam 750 into place the rotatable ends can engage engagement points of each of the first and second towers 730 and 740 until the beam is held securely in place above the patient's chest. FIG. 7D depicts back plate 720 removably attached to each of the first tower 730 and the second tower 740 and beam 750 securely held by each of the first and second towers 730 and 740.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

In general, the various features and processes described above may be used independently of one another, or may be combined in different ways. For example, this disclosure includes other combinations and sub-combinations equivalent to: extracting an individual feature from one embodiment and inserting such feature into another embodiment; removing one or more features from an embodiment; or both removing a feature from an embodiment and adding a feature extracted from another embodiment, while providing the advantages of the features incorporated in such combinations and sub-combinations irrespective of other features in relation to which it is described. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example examples. The example systems and components described herein may be configured differently than described. For example, elements may be added to, removed from, or rearranged compared to the disclosed example examples.

While certain example or illustrative examples have been described, these examples have been presented by way of example only, and are not intended to limit the scope of the inventions disclosed herein. Indeed, the novel methods and systems described herein may be embodied in a variety of other forms. The accompanying claims and their equivalents are intended to cover such forms or modifications as would fall within the scope and spirit of certain of the inventions disclosed herein.

What is claimed:

1. A mechanical cardiopulmonary resuscitation (CPR) device comprising:

a back plate;

a first tower removably attached to the back plate, the first tower comprising a first linear motion device;

a second tower removably attached to the back plate, the second tower comprising a second linear motion device; and a beam releasably connected to each of the first tower and the second tower;

wherein each of the first and second linear motion devices is configured to move one end of the beam toward and away from the back plate;

wherein the first and second linear motion devices are configured to operate in concert such that, when the back plate is resting on a surface, the beam remains substantially parallel to the surface during movement of the beam toward and away from the back plate;

wherein the first linear motion device comprises a first shuttle, a first motor and a first threaded shaft connected to the first shuttle, and wherein the second linear motion device comprises a second shuttle, a second motor and a second threaded shaft connected to the second shuttle; and wherein the first shuttle is configured to releasably connect with a first end of the beam, and wherein the second shuttle is configured to releasably connect with a second end of the beam.

2. The mechanical CPR device of claim 1, wherein the first shuttle comprises one or more engagement points configured to engage the first end of the beam, and wherein the second shuttle comprises one or more engagement points configured to engage the second end of the beam.

3. The mechanical CPR device of claim 2, wherein the first end of the beam comprises a first rotatable end and wherein the second end of the beam comprises a second rotatable end.

4. The mechanical CPR device of claim 3, wherein the beam comprises a first locking mechanism and a second locking mechanism, wherein the first locking mechanism is configured to lock the first rotatable end in a first position and to permit the first rotatable end to rotate in a second position, and wherein the second locking mechanism is configured to lock the second rotatable end in a first position and to permit the second rotatable end to rotate in a second position.

5. The mechanical CPR device of claim 1, wherein the first tower further comprises a first control unit configured to control movement of the first shuttle by controlling the first motor, and wherein the second tower further comprises a second control unit configured to control movement of the second shuttle by controlling the second motor.

6. The mechanical CPR device of claim 1, wherein the first tower comprises a first control unit and the second tower comprises a second control unit.

7. The mechanical CPR device of claim 6, wherein the first control unit and the second control unit are configured to communicate wirelessly.

8. The mechanical CPR device of claim 6, wherein the first control unit and the second control unit are configured to communicate via a wired connection.

9. The mechanical CPR device of claim 8, wherein the wired connection comprises a first electrical connection in the first tower, a second electrical connection in the back plate, and a third electrical connection in the second tower.

10. The mechanical CPR device of claim 9, wherein the first and second control units are configured to verify that the back plate is properly aligned with the first and second towers based on an ability to communicate via the first, second, and third electrical connections.

11. The mechanical CPR device of claim 9, wherein the wired connection further comprises a fourth electrical connection in the first tower, a fifth electrical connection in the beam, and a sixth electrical connection in the second tower.

12. The mechanical CPR device of claim 11, wherein the first and second control units are configured to verify that the beam is properly aligned with the first and second towers based on an ability to communicate via the fourth, fifth, and sixth electrical connections.

13. The mechanical CPR device of claim 6, wherein at least one of the first and second control units is configured to receive one or more user inputs.

14. The mechanical CPR device of claim 13, wherein the first control unit is configured to control the first linear motion device based on the received one or more user inputs, and wherein the second control unit is configured to control the second linear motion device based on the received one or more user inputs.

15. A method comprising:

placing a patient on a back plate;

removably attaching a first tower to the back plate;

removably attaching a second tower to the back plate;

engaging a first rotatable end of a beam to a first linear motion device of the first tower;

engaging a second rotatable end of the beam to a second linear motion device of the second tower; and locking the first and second rotatable ends of the beam such that the beam is located over the patient;

wherein the first and second linear motion devices are configured to move the beam to compress a chest of the patient between the beam and the back plate;

wherein the first linear motion device comprises a first shuttle, a first motor and a first threaded shaft within the first tower, and wherein the second linear motion device comprises a second shuttle, a second motor and a second threaded shaft within the second tower; and wherein the first shuttle is configured to releasably connect with a first end of the beam, and wherein the second shuttle is configured to releasably connect with a second end of the beam.

16. The method of claim 15, wherein placing the patient on the back plate comprises placing the back plate on a surface, the method further comprising:

causing the first and second linear motion devices to move the beam toward and away from the back plate to compress the chest of the patient, wherein the first and second linear motion devices are configured to maintain the beam in a position substantially parallel to the surface during motion of the beam.

17. The method of claim 16, wherein the beam comprises a compression point configured to engage the chest of the patient during motion of the beam.

* * * * *